United States Patent [19]

Ryer et al.

[11] 4,328,003

[45] May 4, 1982

[54] ALCOHOL FUELS OF DECREASED CORROSIVITY

[75] Inventors: Jack Ryer, East Brunswick; Stanley J. Brois; Elbert D. Nostrand, both of Westfield, all of N.J.

[73] Assignee: Exxon Research & Engineering Co., Florham Park, N.J.

[21] Appl. No.: 64,124

[22] Filed: Aug. 6, 1979

[51] Int. Cl.[3] ..... C10L 1/22

[52] U.S. Cl. ..... 44/53; 44/71

[58] Field of Search ..... 44/53, 71; 252/392

[56] References Cited

U.S. PATENT DOCUMENTS

| | | | |
|---|---|---|---|
| 2,330,524 | 9/1943 | Shields | 44/71 |
| 2,789,891 | 4/1957 | Brandes et al. | 44/71 |
| 2,847,292 | 8/1958 | Hager et al. | 44/71 |
| 3,652,242 | 3/1972 | Andress, Jr. | 44/71 |
| 3,826,745 | 7/1974 | Ryer et al. | 252/32.7 E |
| 4,208,190 | 6/1980 | Malec | 44/53 |

OTHER PUBLICATIONS

"DMA-4, Multifunctional Additive", DuPont Petroleum Chemicals.

"A Motor Vehicle Powerplant for Ethanol and Methanol Operation", H. Menrad, Research Div. Wolfswagenwerk AG, Wolfsburg, West Germany.

*Primary Examiner*—Winston A. Douglas

*Assistant Examiner*—Y. Harris-Smith

*Attorney, Agent, or Firm*—Roland A. Dexter; Frank T. Johmann

[57] ABSTRACT

An alkanol fuel, particularly ethanol, for internal combustion engines is modified by the addition of at least a corrosion-inhibiting amount of a metal passivating fuel additive whereby the corrosion-inhibition and if desired carburetor-detergency activities of said fuel is improved.

7 Claims, No Drawings

ALCOHOL FUELS OF DECREASED CORROSIVITY

BACKGROUND OF THE INVENTION

1. Field of the Invention

This invention relates to alcohol fuels for internal combustion engines. In particular, this invention is directed to alcohol fuel containing an anticorrosion additive whereby the metallic e.g. iron-containing structures in the fuel storage-introduction and combustion means are subjected to reduced corrosivity from said fuel.

2. Description of the Prior Art

The present-day energy crisis resulting from the increased demand for petroleum products and the consequential economic drain from those countries has caused them to search of gasoline with such alcohols as methanol and alkanol.

Both methanol and ethanol are two simple alcohols that are well-suited for automotive engine operation. In present-day applications, mixtures of gasoline and small amounts of said alcohols are readily used to provide for efficient operation of automotive engines with less offensive emission products. In some countries such as Brazil, Argentina and the U.S.A., to satisfy their future fuel needs, it is likely that blends of alcohol and gasoline will yield to all alcohol blends.

The production of alcohol from natural sources such as methanol from wood and ethanol from sugar cane, grain and cassava appears to generally result in acid contamination which is corrosive to those metal containment structures for said alkanol fuel. The corrosive nature of natural ethanol fuels has been reported to provoke carburetor deposits of iron-containing salts (see "Experiences With the Utilization of Ethanol/-Gasoline and Pure Ethanol in Brazilian Passenger Cars" by G. Pischinger and N.L.M. Pinto). Unfortunately, alkanol fuels from cellulosic sources are limited in their utilization as fuels for internal combustion engines until the metal, particularly iron, corrosion is reduced.

SUMMARY OF THE INVENTION

It has been discovered that the corrosivity of acids in the alkanols has been markedly reduced by the addition of at least a corrosivity-reducing amount, generally from 0.001 to 0.05, preferably from 0.002 to 0.02, weight percent of a metal passivating fuel additive of the class consisting of: alkylene polyamines having from 4 to 30 carbons and 2 to 11 nitrogens; $C_{12}$ to $C_{36}$ acylated derivatives of said alkylene polyamines; an amine salt of a mixed alkyl acid phosphate which is usefully of the general formula- $$\left[ (R^5O)_2\overset{O}{\overset{\|}{P}}O^- \right]_x \overset{+}{N}HR^1, R^2, R^3$$

wherein x is 1 or 2, $R^5$ is a $C_8$ to $C_{13}$ hydrocarbyl group, $R^2$ and $R^3$ each are a hydrogen atom or $C_3$ to $C_{12}$ hydrocarbyl group, and $R^1$ is selected from the group consisting of- (a) $C_8$ to $C_{18}$ hydrocarbyl groups or mixtures thereof, (b) amino hydrocarbyl groups of the formula $$\text{-}(CH_2)_n NHR^4$$

where x is 1 or $\text{-}(CH_2)_n N^+H_2R^4$ when x is 2, wherein n is 2 or 3 and $R^4$ is (a) above, and (c) alkylene polyamino groups of the formula $$\text{-}(CH_2CH_2NH)_m H$$

wherein m is an integer between 2 and 4; and, mixtures thereof, said weight percent based on the weight of the alkanol fuel.

DETAILED DESCRIPTION OF THE INVENTION

Alkanol Fuels

Although the lower $C_1$ to $C_5$ alkanols are readily utilized as fuels for internal combustion engines, methanol and ethanol are most easily produced from natural materials such as wood, sugar cane, grains including corn, wheat and milo and cassava as by fermentation and similar processes for breaking down the respective sugars into said alkanols.

In the production of ethanol e.g. trace amounts of acid and ester are found to be present. Typically ethyl alcohol for direct combustion has the following properties:

| Properties | | Combustible Ethyl Alcohol |
|---|---|---|
| Specific gravity @ 20° C. | | 0.8073- 0.8150 |
| Ash | mg/100 ml. max | 5.0 |
| Total Acid | mg/100 ml max | 3.0 |
| Aldehydes | mg/100 ml max | 6.0 |
| Esters | mg/100 ml max | 8.0 |
| Higher alcohols | mg/100 ml max | |

The acid is primarily acetic acid present in amounts of from 0.003% and higher since the level depends at least upon the extent of further oxidation of acid precursors, particularly acetaldehyde. The ester is primarily ethyl acetate present in amounts up to about 0.008% which ester can readily hydrolyze in the presence of said acid to yield more acetic acid.

The acetic acid appears to readily complex the iron present in the metal surfaces contiguous with the alcohol to form an alcohol soluble ionic iron species, readily leached from the metal surface by the alcohol fuel.

METAL PASSIVATING FUEL ADDITIVE

The corrositivity-inhibiting and/or metal passivating additive to be added in at least a corrosive-inhibiting amount to said alcohol fuel, particularly to said ethanol, provides activity to the fuel so that the metal surfaces are not attacked in a metal solubilizing reaction with the acidic anions of the fuel. The additive has a solubility in the alkanol of at least 5% by weight at 20° C. The general useful concentration in the fuel ranges from about 0.0001 to 0.02, preferably 0.005 to 0.015, optimally 0.01, weight percent based on the total weight of the fuel.

1. Alkylene Polyamines

The alkylene polyamines useful herein are those having the following formulas:

(a) alkylene polyamines $$H-\underset{\underset{R}{|}}{N}-\left(\text{alkylene}-\underset{\underset{R}{|}}{N}\right)_x-H$$

wherein x is an integer of about 1 to 10, preferably about 2 to 4, R is hydrogen, a hydrocarbon or substantially a hydrocarbon group containing about 1 to 7, preferably about 1 to 4 carbon atoms and the alkylene radical is a straight or branched chain alkylene radical having up to about 7 preferably about 2 to 4 carbon atoms; and, (b) polyoxyalkylene polyamines (i) $NH_2$—alkylene-(O-alkylene)$_m$-$NH_2$ where m has a value of about 3 to 70 and preferably 10 to 35 and (ii) R-(alkylene-(O-alkylene)$_n$-$NH_2$)$_{3-6}$ where n has a value of about 1 to 40 with the proviso that the sum of all the n's is from about 3 to about 70 and preferably from about 6 to about 35 and R is a polyvalent saturated hydrocarbon radical of up to ten carbon atoms having a valence of 3 to 6. The alkylene groups in either formula (i) or (ii) may be straight or branched chains containing about 1 to 7 and preferably about 1 to 4 carbon atoms.

The alkylene polyamines of formula (a) above include, for example, methylene amines, ethylene amines, butylene amines, propylene amines, pentylene amines, hexylene amines, heptylene amines, octylene amines, other polymethylene amines, and the cyclic and higher homologs of these amines such as the piperazines, and the amino-alkyl-substituted piperazines. These amines include, for example, ethylene diamine, triethylene tetramine, propylene diamine, di(heptamethylene) triamine, tripropylene tetramine, tetraethylene pentamine, trimethylene diamine, pentaethylene hexamine, di(-trimethylene) triamine, 2-heptyl-3-(2-aminopropyl) imidazoline, 4-methylimidazoline, 1,3-bis-(2-aminoethyl) imidazoline, pyrimidine, 1-(2-aminopropyl) piperazine, 1,4-bis-(2-aminoethyl) piperazine, N,N-dimethylaminopropyl amine, N,N-dioctylethyl amine, N-octyl-N'-methylethylene diamine, and 2-methyl-1-(2-aminobutyl) piperazine. Other higher homologs which may be used can be obtained by condensing two or more of the above-mentioned alkylene amines in a known manner.

The ethylene amines which are particularly useful include diethylene triamine, tetraethylene pentamine, octaethylene, nonamine, tetrapropylene, pentamine, as well as various cyclic polyalkyleneamines. A particularly useful alkylene amine comprises a mixture of ethylene amines prepared by the reaction of ethylene chloride and ammonia which may be characterized as having a composition that corresponds to that of tetraethylene pentamine.

Alkylene amines having one or more hydroxyalkyl substituents on the nitrogen atoms may be used. These hydroxy-alkyl-substituted alkylene amines are preferably compounds wherein the alkyl group is a lower alkyl group, i.e. having less than about 6 carbon atoms and include, for example, N-(2-hydroxyethyl) ethylene diamine, N,N'-bis(2-hydroxyethyl) ethylene diamine, 1-(2-hydroxyethyl) piperazine, monohydroxypropylsubstituted diethylene triamine, 1,4-bis(2-hydroxypropyl)-piperazine, dihydroxy-propyl-substituted tetraethylene pentamine, N-(3-hydroxy-propyl) tetramethylene diamine, 2-heptadecyl-1-(2-hydroxyethyl) imidazole, etc.

The polyoxyalkylene polyamines of formula (b) above, e.g. polyoxyalkylene diamines and polyoxyalkylene triamines, may have average molecular weights ranging from ranging from about 200 to about 4000 and preferably from about 400 to 2000. The preferred polyoxyalkylene polyamines for purposes of this invention include the polyoxyethylene and polyoxypropylene diamines and the polyoxypropylene triamines having average molecular weights ranging from about 200 to 2000. The polyoxyalkylene polyamines are commercially available and may be obtained, for example, from the Jefferson Chemical Company, Inc. under the trade name "Jeffamines D-230, D-400, D-1000, D-2000, T-403", etc.

2. $C_{12}$ to $C_{36}$ Acylated Alkylene Polyamines

These additives are obtained from the reaction of fatty acids having from twelve to thirty-six, preferably fourteen to twenty, optimally eighteen total carbons reacted with an alkylene polyamine in a nitrogen equivalent basis such that at least about one amino group is not amidated. Exemplary of this is the reaction of three moles of isostearic acid for each mole of tetraethylene pentamine.

The alkylene polyamines are those discussed above. The fatty acids are usefully aliphatic monocarboxy acids having a linear carbon chain of at least 8, preferably 12, carbons. Representative fatty acids include lauric, oleic, stearic isostearic, valeric, eicosanoic, docosanoic, hexacosanoic, triacontanoic, etc. Preferred is isostearic acid.

Not only does this group of compounds passivate the metal exposed to the alkanol fuel but they also provide carburetor detergent activity and/or rust inhibiting activity to the fuel. These properties are also shared by the succeeding group, i.e. the amine salts of mixed alkyl phosphates.

3. Amine Salts of Mixed Alkyl Acid Phosphates

In accordance with this invention, a particularly useful fuel additive has the general formula:

$$\left[ (R^5O)_2\overset{\overset{\displaystyle O}{\|}}{P}O- \right]_x \overset{+}{N}HR^1, R^2, R^3$$

wherein x is 1 or 2, $R^5$ is a $C_8$ to $C_{13}$ hydrocarbyl group, $R^2$ and $R^3$ each are a hydrogen atom or $C_3$ to $C_{12}$ hydrocarbyl group, and $R^1$ is selected from the group consisting of:

(a) $C_8$ to $C_{18}$ hydrocarbyl groups or mixtures thereof, (b) amino hydrocarbyl groups of the formula $$-(CH_2)_nNHR^4$$

where x is 1 or $-(CH_2)_nN^+H_2R^4$ when x is 2, wherein n is 2 or 3 and $R^4$ is (a) above; and (c) alkylene polyamino groups of the formula $$-(CH_2CH_2NH)_mH$$

wherein m is an integer between 2 and 4. Preferably, $R^2$ and $R^3$ are each hydrogen atoms or $C_3$ to $C_4$ alkyl groups, and $R^1$ is (b) wherein $R^4$ is a substantially linear $C_{12}$ to $C_{18}$ aliphatic group. Examples of said amine phosphates include a commercial amine phosphate consisting of an 80% solution of amine salt of mixed alkyl acid phosphates in kerosene. In this preferred amine, $R^5$ is the hydrocarbyl portion of a $C_8$ Oxo alcohol, $R^2$ and $R^3$ are H, and $R^1$ is $$-CH_2CH_2CH_2N^+H_2C_{18}H_{37}$$

Other amine phosphate salts generally suitable for use in the present invention include compounds of the structures:

$$(C_{13}H_{27}O)_2PO_2NH_3(CH_3)_3CH_3,$$

$$(C_8H_{17}O)_2PO_2NH_3CH_2\overset{\overset{CH_2CH_3}{|}}{C}H(CH_2)_3CH_3 \text{ and}$$

$$(C_8H_{17}O)_2PO_2)_xNH_3{-}(CH_2CH_2NH)_4{-}H \text{ when } x \text{ is } 1, 2 \text{ or } 3.$$

An amine (most likely Duomeen C) salt of mixed alkyl acid phosphates is commercially available as DMA-4 from Petroleum Chemicals, Wilmington, Delaware, E. I. duPont de Nemours & Co. This invention has made it possible to dramatically inhibit the iron corrosivity of naturally-produced lower alkanols, particularly, ethanol.

This invention will be further understood by reference to the following Examples which include preferred embodiments of the invention.

EXAMPLES 1-3

An untreated sample of ethyl alcohol containing water (5 wt.%), acetic acid (0.003 wt.%) and ethyl acetate (0.008 wt.%) along with samples each admixed with 0.006 wt.% of DMA-4, and 0.006 wt.% of LZ 575 (believed to be $C_8$ to $C_{13}$ alkyl hydrogen phosphate polyamine) sold by Lubrizol Corp. of Cleveland, Ohio respectively, to provide in order of disclosure test samples 1, 2 and 3 respectively.

EXAMPLE 4

Test Samples 2 and 3 along with sample 1, which was a control of said ethyl alcohol containing said water, acetic acid and ethyl acetate were each subjected to a corrosivity test based on the National Association of Corrosion Engineers (NACE) Rust Test Procedure wherein the comparative results are measured in mg. loss in the spindle.

The NACE Test uses a 300 ml. sample of test fuel which is stirred at 38° C. with a polished carbon steel spindle of 0.5" diameter and 3.5" length immersed in said test fuel. After 30 minutes, 30 ml. of distilled water is added and stirring continued for 3.5 hours. After rising with 50 ml. of heptane and air drying the spindle is weighed for weight loss.

The results are shown in Table I.

TABLE I

| Test Sample | mg. loss |
|---|---|
| 1 | 0.23 |
| 2 | 0.001 |
| 3 | 0.001 |

These data are evident that the treated alkanol fuel according to the invention prevents corrosion and provides a useful fuel for automotive purposes.

EXAMPLE 5

A blend of fuel was made up consisting of:

| Component | Wt. % |
|---|---|
| Ethyl alcohol | 89.3 |
| water | 4.7 |
| acetic acid | 2.0 |
| ethyl acetate | 4 |

An aliquot portion of the blend was run in the NACE Test with a resultant severe corrosion of the test spindle and dark browning of the blend. An aliquot portion of said blend was then modified by the addition of 1.25 wt.% of tetraethylene pentamine and thereafter subjected to said NACE Test. The result was no perceptible corrosion or loss of weight of the test spindle and no perceptible color change of the modified blend.

The invention in its broader aspect is not limited to the specific details shown and described and departures may be made from such details without departing from the principles of the invention and without sacrificing its chief advantages.

What is claimed is:

1. A fuel useful in internal combustion engines comprising a major amount of a $C_1$ to $C_5$ alkanol and at least a corrosivity-reducing amount of a metal passivating fuel additive selected from the group consisting of:

(A) alkylene polyamines having from 4 to 30 carbons and 2 to 11 nitrogens;

(B) $C_{12}$ to $C_{36}$ acylated derivatives of said alkylene polyamines; and (C) an amine salt of an alkyl acid phosphate which is of the general formula- $$\left((R^5O)_2\overset{\overset{O}{\|}}{P}O^-\right)_x\overset{+}{N}HR^1R^2R^3$$

wherein x is 1 or 2, $R^5$ is a $C_8$ to $C_{13}$ hydrocarbyl group, $R^2$ is a hydrogen atom or $C_3$ to $C_{12}$ hydrocarbyl group, $R^3$ is a hydrogen atom or $C_3$ to $C_{12}$ hydrocarbyl group, and $R^1$ is selected from the group consisting of- (a) $C_8$ to $C_{18}$ hydrocarbyl groups or mixtures thereof, (b) amino hydrocarbyl groups of the formula $\text{-}(CH_2)_nNHR^4$ where x is 1 or $\text{-}(CH_2)_nN^+H_2R^4$ when x is 2, wherein n is 2 or 3 and $R^4$ is (a) above, and (c) alkylene polyamino groups of the formula $\text{-}(CH_2CH_2NH)_mH$ wherein m is an integer between 2 and 4, and, mixtures thereof.

2. A fuel according to claim 1 wherein said alkanol is ethanol containing acid contamination and said additive is an alkylene polyamine of the formula $$H{-}\underset{\underset{R}{|}}{N}\text{-alkylene}{-}\underset{\underset{R^x}{|}}{N}{-}H$$

wherein x is an integer of 1 to 10, R is hydrogen or a hydrocarbon group of 1 to 7 carbon atoms, and the alkylene radical has 2 to 4 carbon atoms.

3. A fuel according to claim 2 wherein said acid contamination is from acetic acid and said additive is tetraethylene pentamine present in from 0.0001 to 0.02 weight percent based on the total weight of the fuel.

4. A method for reducing the metal corrosivity of an alkanol fuel for automobile engines comprising the step of adding to said alkanol at least a corrosivity-reducing amount, in the range of about 0.0001 to 0.02 wt. %, based on the total weight of the fuel, of a metal passivating fuel additive selected from the group consisting of:

(A) alkylene polyamines having from 4 to 30 carbons and 2 to 11 nitrogens;

(B) $C_{12}$ to $C_{36}$ acylated derivatives of said alkylene polyamines; and (C) an amine salt of a mixed alkyl acid phosphate which is of the general formula- $$\left( (R^5O)_2\overset{\overset{O}{\|}}{P}O^- \right)_x \overset{+}{N}HR^1R^2R^3$$

wherein x is 1 or 2, $R^5$ is a $C_8$ to $C_{13}$ hydrocarbyl group, $R^2$ is a hydrogen atom or $C_3$ to $C_{12}$ hydrocarbyl group, $R^3$ is a hydrogen atom or $C_3$ to $C_{12}$ hydrocarbyl group, and $R^1$ is selected from the group consisting of- (a) $C_8$ to $C_{18}$ hydrocarbyl groups or mixtures thereof, (b) amino hydrocarbyl groups of the formula $\text{-}(CH_2)_nNHR^4$ where x is 1 or $\text{-}(CH_2)_nN^+H_2R^4$ when x is 2, wherein n is 2 or 3 and $R^4$ is (a) above, and (c) alkylene polyamino groups of the formula $\text{-}(CH_2CH_2NH)_mH$ wherein m is an integer between 2 and 4, and, mixtures thereof.

5. A fuel according to claim 1, wherein said alkanol is ethanol produced from natural material by fermentation and containing acidic comtamination.

6. A fuel according to claim 5, wherein said additive is said amine salt of an alkyl acid phosphate.

7. A fuel according to claim 5, wherein said additive is $C_8$ to $C_{13}$ alkyl hydrogen phosphate polyamine.

* * * * *